US008152433B2

(12) United States Patent
Yamada et al.

(10) Patent No.: US 8,152,433 B2
(45) Date of Patent: Apr. 10, 2012

(54) LOADER VEHICLE HAVING A LIFT ARM

(75) Inventors: Masami Yamada, Kariya (JP); Hidehito Kondou, Kariya (JP); Masami Sakamoto, Kariya (JP); Koichiro Mori, Kariya (JP)

(73) Assignee: Kabushiki Kaisha Aichi Corporation, Saitama (JP)

( * ) Notice: Subject to any disclaimer, the term of this patent is extended or adjusted under 35 U.S.C. 154(b) by 316 days.

(21) Appl. No.: 12/150,149

(22) Filed: Apr. 25, 2008

(65) Prior Publication Data

US 2008/0267754 A1 Oct. 30, 2008

(30) Foreign Application Priority Data

Apr. 27, 2007 (JP) ..... P2007-117939

(51) Int. Cl.
*B66C 23/00* (2006.01)

(52) U.S. Cl. ..... 414/686; 414/680; 414/917

(58) Field of Classification Search ..... 414/686, 414/685, 680, 917
See application file for complete search history.

(56) References Cited

U.S. PATENT DOCUMENTS

| | | | | |
|---|---|---|---|---|
| 5,169,278 | A | 12/1992 | Hoechst et al. | 414/685 |
| 5,470,190 | A | 11/1995 | Bamford et al. | 414/686 |
| 5,542,814 | A | 8/1996 | Ashcroft et al. | 414/815 |
| 5,609,464 | A | 3/1997 | Moffitt et al. | 414/685 |
| 6,132,163 | A | 10/2000 | Andrews et al. | 414/685 |
| 6,325,589 | B1 * | 12/2001 | Jang et al. | 414/686 |
| 6,474,933 | B1 | 11/2002 | Hoechst et al. | 414/815 |
| 6,616,398 | B2 | 9/2003 | Dershem et al. | 414/686 |
| 6,796,762 | B2 | 9/2004 | Vicars, III et al. | 414/685 |
| 6,854,951 | B2 | 2/2005 | Mimuro | 414/686 |
| 7,507,064 | B2 * | 3/2009 | Shibuya | 414/686 |
| 2003/0082040 | A1 * | 5/2003 | Bares et al. | 414/680 |

FOREIGN PATENT DOCUMENTS

| | | | |
|---|---|---|---|
| GB | 2 368 573 | A | 5/2002 |
| JP | 2006-307498 | A | 11/2006 |

OTHER PUBLICATIONS

Examiner's Report for Australian patent application No. 2008201808, issued Sep. 2, 2009.
Korean Office Action issued Nov. 23, 2009.

* cited by examiner

*Primary Examiner* — Donald Underwood
(74) *Attorney, Agent, or Firm* — Locke Lord LLP

(57) ABSTRACT

A loader vehicle includes a main frame, a lift arm, and a lift cylinder. The lift arm is connected to the main frame. A working implement is attached to the lift arm at the front end thereof. The lift cylinder is connected to the lift arm and the main frame. The lift cylinder includes a piston, a piston rod fixed to the piston, and a cylinder tube. The piston rod is connected to the main frame. The cylinder tube has a bottom portion and a side wall portion. The cylinder tube is connected to the lift arm by a connecting portion. The connecting portion is provided at the side wall portion of the cylinder tube.

8 Claims, 8 Drawing Sheets

LOADER VEHICLE HAVING A LIFT ARM

BACKGROUND OF THE INVENTION

The present invention relates to a loader vehicle having a lift arm and a working implement to be raised and lowered.

U.S. Pat. No. 5,609,464 discloses a loader vehicle having a bucket at an end of a lift arm to be raised substantially vertically. The lift arm is connected to a vehicle frame through a control arm at the front side, a lift link at the rear side, and a cylinder. U.S. Pat. No. 5,169,278 discloses a loader vehicle with a similar basic structure.

However, in U.S. Pat. No. 5,609,464, the connecting position of the cylinder to the vehicle frame is located rearward of the rear wheel and lower than the top end of the real wheel. Therefore, it is required that the space rearward of the rear wheel is widely ensured for region for pivoting movement of the cylinder. As a result, other parts are not provided at the rear space of the rear wheel thereby wasting the space. In U.S. Pat. No. 5,169,278, the space rearward of the rear wheel is wasted, similarly.

The present invention is directed to a loader vehicle which effectively uses a rear space thereof.

SUMMARY OF THE INVENTION

According to the present invention, a loader vehicle includes a main frame, a lift arm, and a lift cylinder. The lift arm is connected to the main frame. A working implement is attached to the lift arm at the front end thereof. The lift cylinder is connected to the lift arm and the main frame. The lift cylinder includes a piston, a piston rod fixed to the piston, and a cylinder tube. The piston rod is connected to the main frame. The cylinder tube has a bottom portion and a side wall portion. The cylinder tube is connected to the lift arm so as to form a connecting portion. The connecting portion is provided at the side wall portion of the cylinder tube.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

The following will describe a skid steer loader as a loader vehicle according to a preferred embodiment of the present invention with reference to FIGS. 1 through 8. In this embodiment, the fore-and-aft direction indicates the front and rear direction of the loader vehicle. The width direction indicates the direction perpendicular to the fore-and-aft direction and at the same time the horizontal direction.

[Overall Structure]

Figure 1:
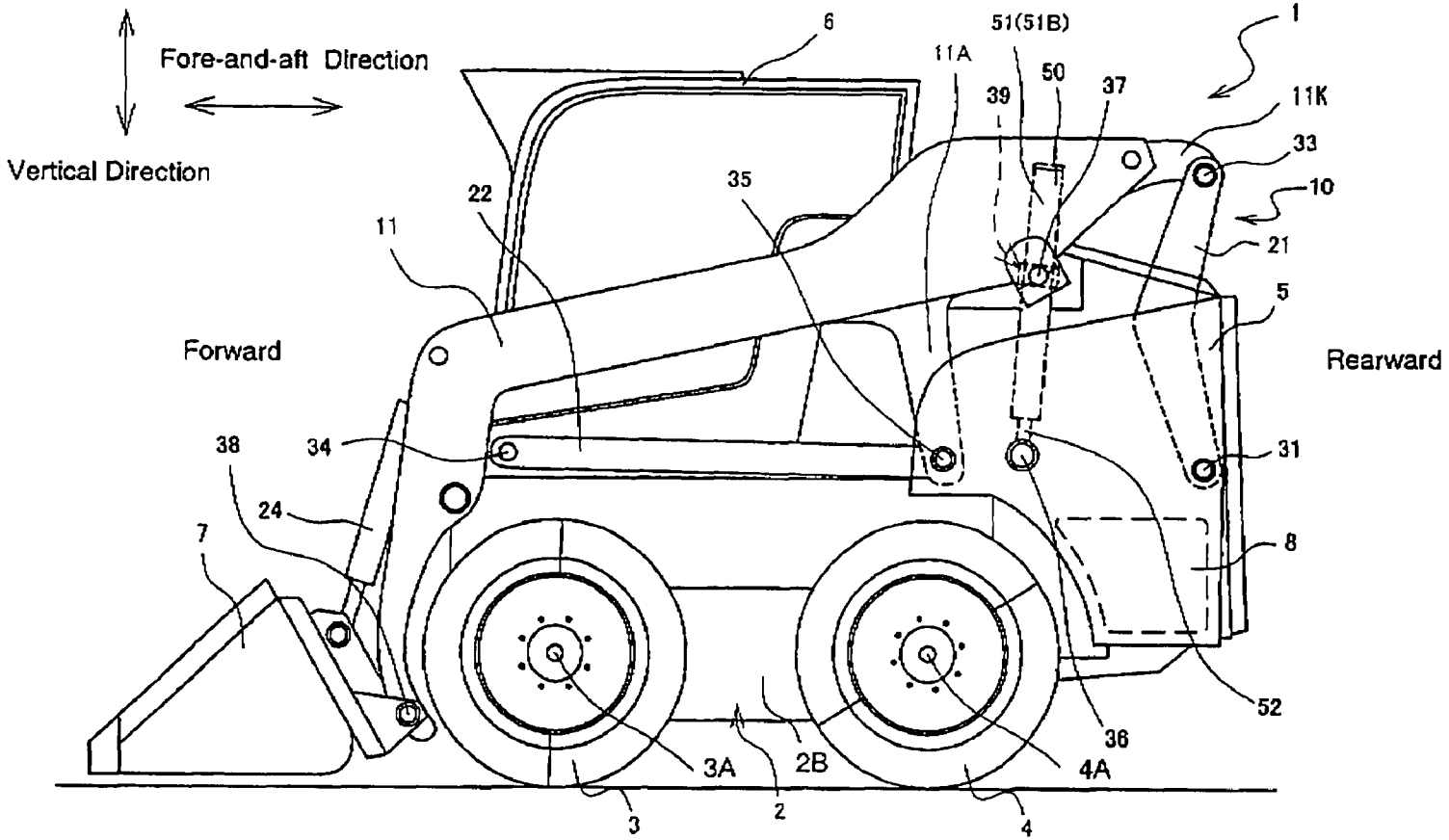
FIG. 1 is a side view of an overall skid steer loader as a loader vehicle according to a preferred embodiment of the present invention.
Figure 2:
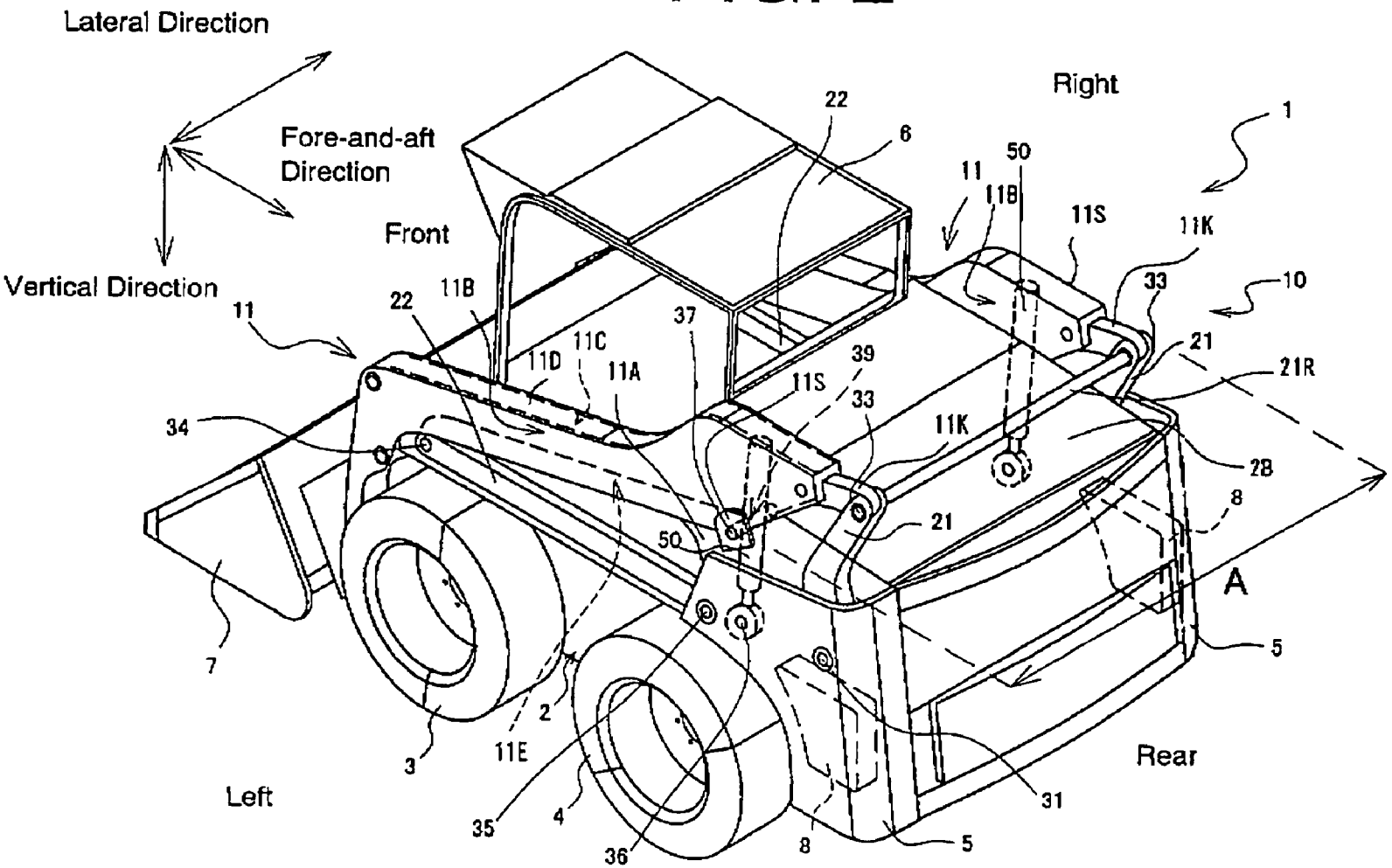
FIG. 2 is a perspective view of the skid steer loader of FIG. 1 as viewed from above and behind.

Referring to FIGS. 1 and 2, a skid steer loader (a loader vehicle) 1 includes a main frame 2, lift arms 11, and lift cylinders 50. The main frame 2 is supported by front wheels 3 and rear wheels 4. The front and rear wheels 3, 4 are driven by a vehicle engine (not shown) provided in the main frame 2. The lower part of the main frame 2 has a rigid structure so as to accommodate a box for storing chains and the like (not shown) for driving the front and rear wheels 3, 4. A cabin 6 is mounted on the front part of the main frame 2 so as to accommodate an operator's seat therein. The engine (not shown), a counter weight 8 and the like are provided in the rear part of the main frame 2. FIGS. 1 and 2 show a state of the skid steer loader 1 where the lift arms 11 are lowered to the lowermost position.

The skid steer loader 1 has a pair of the lift arms 11, 11 at the right and left sides so that the lift arms 11 are operable to be raised and lowered. The cabin 6 is interposed between the both lift arms 11. The lift arms 11 are constructed as a double arm type. A bucket (working implement) 7 is attached to the front ends of the lift arms 11. The bucket 7 is located in the front part of the skid steer loader 1. The skid steer loader 1 further includes a pair of front links 22, 22, a pair of rear links 21, 21, and a pair of the lift cylinders 50, 50. Each of the front links 22, the rear links 21, and the lift cylinders 50 are provided at the right and left sides of the skid steer loader 1, respectively. One end of each front link 22 is connected to each lift arm 11, and the other end of each front link 22 is connected to the main frame 2. Similarly, the rear links 21 and lift cylinders 50 are connected to the lift arms 11 and the main frame 2 (shown in FIGS. 1 and 2).

The lift arm 11, the front link 22, the rear link 21, and the lift cylinder 50 are arranged so as to overlap with the front and rear wheels 3, 4 in a top view. In other words, the lift arm 11, the front link 22, the rear link 21, and the lift cylinder 50 are not located in a space formed between the wheels 3, 4 and the main frame 2 in the top view. In this embodiment, a raising and lowering device 10 includes the lift cylinder 50, the front link 22, and the rear link 21.

The main frame 2 of the skid steer loader 1 includes a main body 2B, and a pair of support members 5, 5. The support members 5 are formed by bending the both right and left sides of the rear part of a plate-like member.

The following will describe the details of the lift arms 11, the front links 22, the rear links 21, and the lift cylinders 50. The above-described paired members (the lift arms 11, the front links 22, the rear links 21, the lift cylinders 50, the support members 5, the front and rear wheels 3, 4, and the like) are provided at the right and left sides substantially symmetrically. Therefore, one of the paired members will be explained, and the explanation for the other may be omitted.

[Lift Arm]

The lift arm 11 is located at a position above the front and the rear wheels 3, 4 (at a position where the lift arm 11 overlaps with the front and the rear wheels 3, 4 in the top view). FIGS. 1 and 2 show the lift arms 11 which are lowered (a state where the bucket 7 is at the lowermost position). As shown in FIGS. 1 and 2, the lift arm 11 is initially extended frontward through the space above the wheels 3, 4 so as to be inclined slightly downward, and then is bent downward. The front end of the lift arm 11 is located in the vicinity of the front wheel 3. A lower protrusion 11A is formed at a position closer to the proximal end 11K (rear side) of the lift arm 11 than the longitudinal middle portion of the lift arm 11.

The bucket 7 (working implement) 7 is pivotally attached to the front end of the lift arms 11 through a pin 38. A bucket cylinder 24 is provided adjacent to the front end of the lift arm 11 for pivoting the bucket 7.

The lift arm 11 includes two side plate portions 11B, 11C, a top plate portion 11D, and a bottom plate portion 11E. The lift arm 11 has a square cross-section with a hollow center over the entire length. The side plate portions 11B, 11C are arranged so as to face to each other in the width direction, when the lift arm 11 is attached to the skid steer loader 1. An insertion hole is formed in the bottom plate portion 11E so that a part of the lift cylinder 50 is inserted in the lift arm 11. The connection between the lift cylinder 50 and the lift arm 11 will be described later.

Each of the lift arms 11 is provided along the fore-and-aft direction of the main frame 2. The paired lift arms 11 are provided so as to face to each other in the width direction (as shown in FIG. 2). The both lift arms 11 have corresponding outermost surfaces 11S, 11S in the width direction (as shown in FIG. 2). In this embodiment, a supporting member provided at the surface of the side plate portion 11B is located at the outermost in the width direction, and thereby serves as the outermost portion 11S. However, any surface located at the outermost in the width direction may serve as the outermost surface. For example, the surfaces of the side plate portions 11B, 11C may serve as the outermost surface, when there is no supporting member.

[Rear Link]

The rear link 21 is formed of a curved-shape in a side view. The upper end (one end) of the rear link 21 is pivotally connected to the proximal end 11K of the lift arm 11 through a pin 33. The lower end (the other end) of the rear link 21 is pivotally connected to the main body 2B and the support member 5 through a pin 31. The pin 31 is positioned rearward of a rear axle 4A in the side view. The skid steer loader 1 is constructed such that the bucket 7 is raised and lowered in the vertical direction in accordance with the upward and downward movement of the lift arm 11 supported by the rear link 21. The movement of the lift arm 11 will be described later.

[Front Link]

The front link 22 is formed linearly in a side view. The front end of the front link 22 is pivotally connected to the front part of the main body 2B of the main frame 2 through a pin 34. The rear end of the front link 22 is pivotally connected to the lower end portion of the lower protrusion 11A of the lift arm 11 through a pin 35.

[Lift Cylinder]

Figure 3:
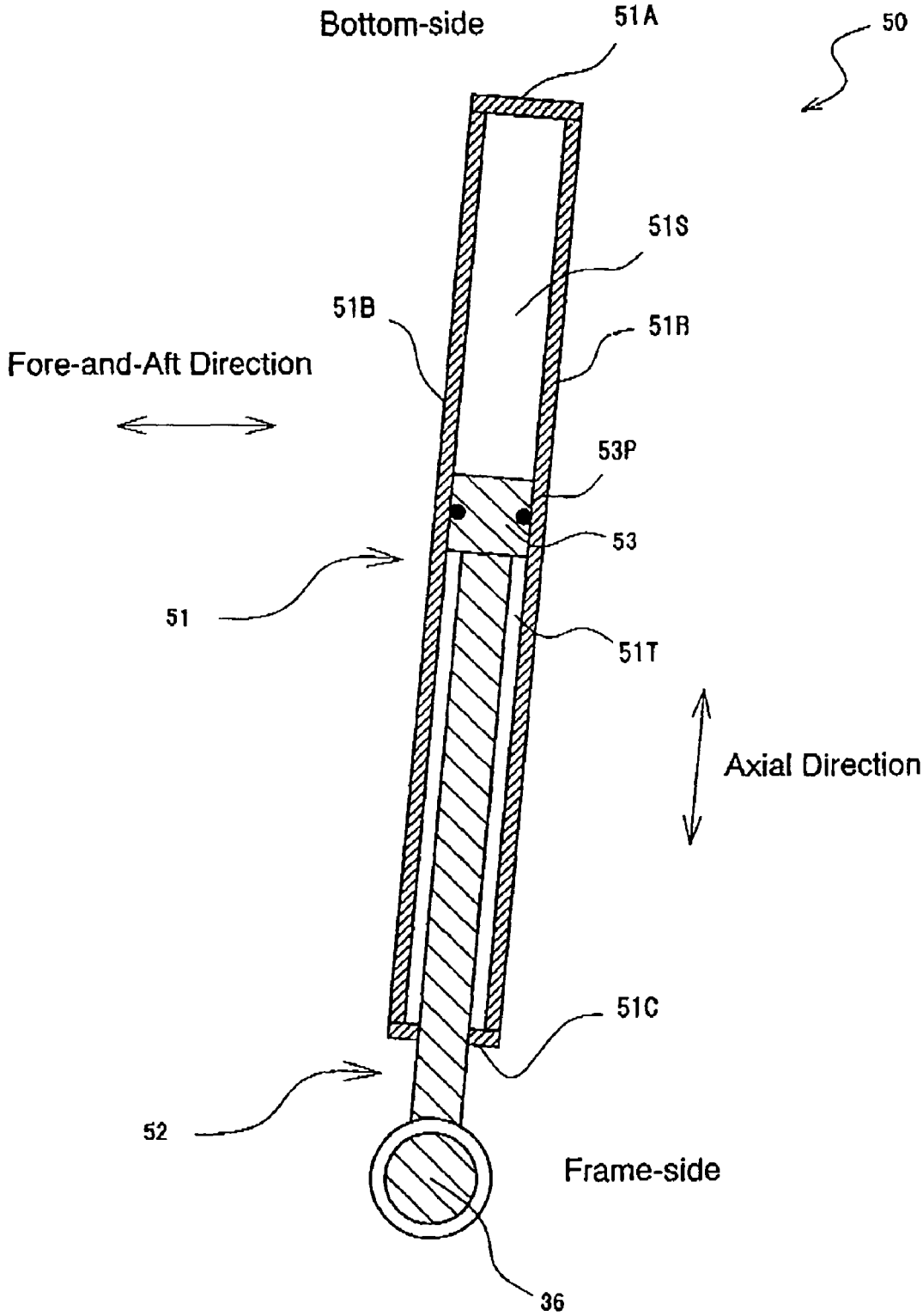
FIG. 3 is a longitudinal cross-sectional view of a lift cylinder of the skid steer loader of FIG. 1 illustrating the inner construction thereof.
Figure 4:
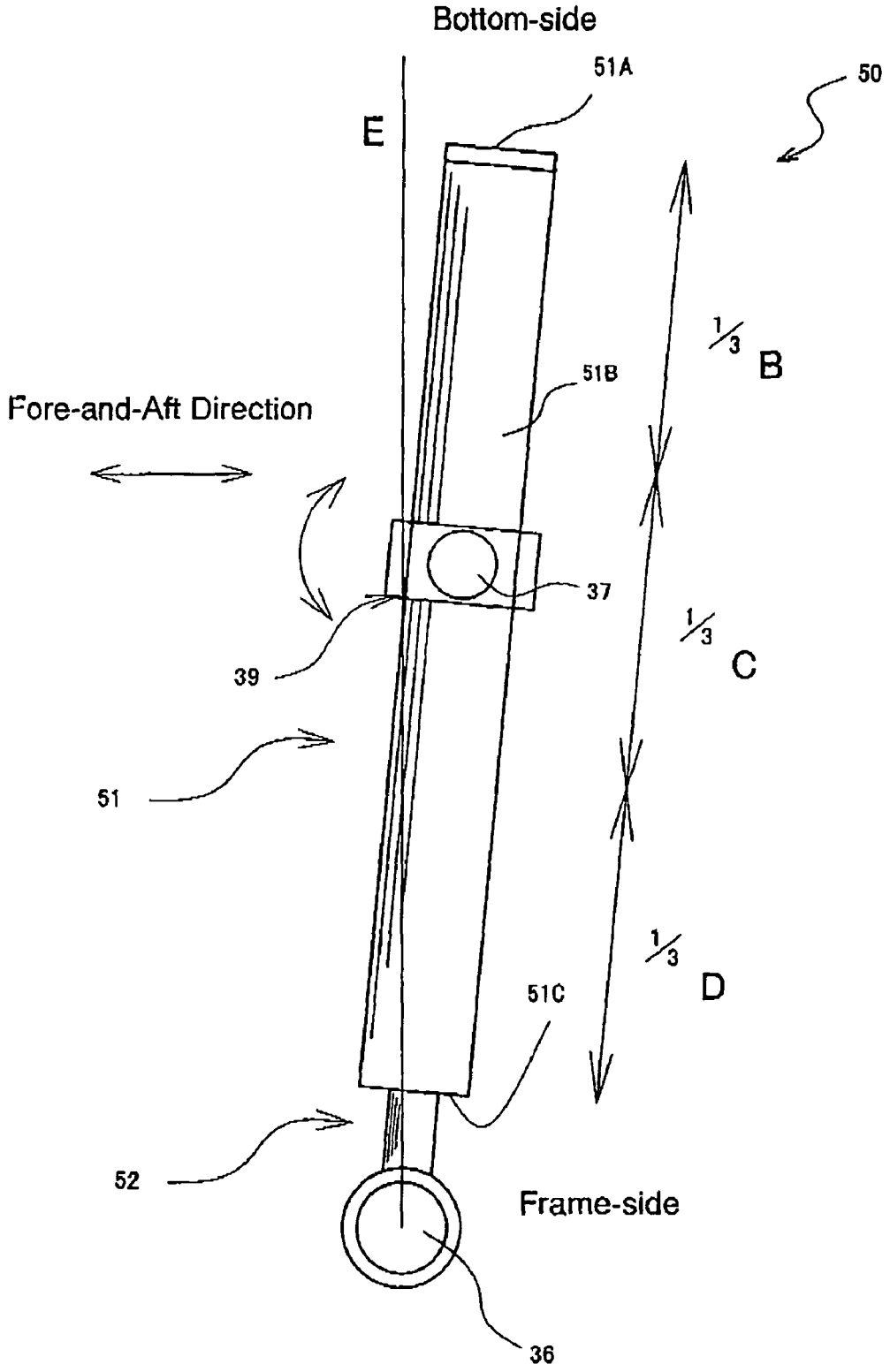
FIG. 4 is a side view of the lift cylinder of the skid steer loader of FIG. 1 illustrating a state where the lift cylinder is connected.

The following will describe the details of the lift cylinder 50 with reference to FIGS. 3 and 4. FIG. 4 is an enlarged view of the lift cylinder 50 of FIG. 1. The lift cylinder 50 is a fluid pressure cylinder, or, more particularly, a hydraulic cylinder. The lift cylinder 50 is connected to a hydraulic supply means (e. g. an oil pump operated by an engine) through a control valve (e. g. an electromagnetic valve). The control valve is controlled so as to be opened and closed by a control means (e. g. a microcomputer type controller). The hydraulic supply means, the control valve, and the control means are not shown in the drawings.

As shown in FIG. 3, the lift cylinder 50 includes a piston 53, a bar-shaped piston rod 52, and a cylinder tube 51. The piston rod 52 is fixed to the piston 53. The cylinder tube 51 includes a bottom portion 51A, a side wall portion 51B, and a support plate 51C. It is noted that the axial opposite ends of the side wall portion 51B (the cylinder tube 51, or the lift cylinder 50) are designated as a bottom-side and frame-side (top-side). The bottom side is adjacent to the bottom portion 51A, or adjacent to the lift arm 11. The frame side is adjacent to the main frame 2. The support plate 51C has an insertion hole, and one end of the piston rod 52 is inserted in the cylinder tube 51 through the insertion hole of the support plate 51C. The piston 53 has an annular seal ring 53P for preventing oil leakage at the periphery thereof. The seal ring 53P is made of rubber. When the lift cylinder 50 is assembled, the piston 53 and the end portion of the piston rod 52 are inserted in the cylinder tube 51. In this state, the piston 53 and the piston rod 52 are slidable with respect to the cylinder tube 51 in the axial direction of the cylinder tube 51. The outer circumference of the piston 53 and the inner circumference of the cylinder tube 51 are in slide contact with each other when the piston rod 52 and the piston 53 are moved.

The cylinder tube 51 includes a first space 51S and a second space 51T therein. The first space 51S and the second space 51T are partitioned by the piston 53. The first space 51S is adjacent to the bottom portion 51A, or on the bottom-side. The second space 51T is adjacent to the main frame 2, or on the frame-side. Hydraulic oil is introduced from the hydraulic supply means to the first space 51S. The seal ring 53P prevents the oil from leaking out from the first space 51S to the second space 51T.

The piston rod 52 of the lift cylinder 50 is connected to the main frame 2. The cylinder tube 51 of the lift cylinder 50 is connected to the lift arm 11 (shown in FIGS. 1 and 2). The following will describe the connection of the lift cylinder 50.

One end of the piston rod 52 is pivotally connected to the main body 2B and the support member 5 through a pin 36 (shown in FIGS. 2 through 4).

The lift cylinder 50 has a connecting portion 39 in which the cylinder tube 51 and the lift arm 11 are pivotally connected through a pin 37. The connecting portion 39 is provided at the side wall portion 51B of the cylinder tube 51 (as shown in FIGS. 1 and 4). The connecting portion 39 is positioned rearward of the proximal end of the lower protrusion 11A (as shown in FIGS. 1 and 2).

As shown in FIG. 4, the connecting portion 39 is positioned within the range of two-thirds of the entire length of the side wall portion 51B adjacent to the frame-side of the cylinder tube 51. In FIG. 4, the side wall portion 51B has three regions B, C, and D, which are substantially equal in length and are defined in this order from bottom-side of the cylindrical tube 51. The connecting portion 39 is specifically positioned in the middle region C. That is, the connecting portion 39 is positioned within the range of one-third of the entire length of the side wall portion 51B, excluding the region D which is one-third of the entire length of the side wall portion 51B adjacent to the frame-side.

As shown in FIGS. 1 and 4, when the bucket 7 is at the lowermost position, the bottom-side of the lift cylinder 50 is positioned rearward of the frame-side in the skid steer loader 1. That is, the lift cylinder 50 is tilted rearward with respect to the vertical direction (the direction indicated by a line "E" in FIG. 4).

The paired lift cylinders 50, 50 are provided between the outermost surfaces 11S, 11S of the paired lift arms 11, 11 in the width direction, or within the region A as shown in FIG. 2. In more detail, the lift cylinder 50 is provided in such a way that a part of the lift cylinder 50 is inserted in the insertion hole of the bottom plate portion 11E of the lift arm 11. The lift cylinder 50 is connected to the lift arm 11 in such a way that a part of the cylinder tube 51 is interposed between the two side plate portion 11B, 11C. That is, the lift cylinder 50 is arranged so as to overlap with the lift arm 11 (so that the lift cylinder 50 is located within the width of the lift arm 11 in the top view) in the width direction.

[Connecting Position]

As described above, the connecting portion 39 of the lift cylinder 50 to the lift arm 11 is provided at the side wall portion 51B of the cylinder tube 51. As constructed above, the connecting position (the position of the pin 36) of the lift cylinder 50 to the main frame 2 is located at an upper part in the main frame 2. The connecting position of the preferred embodiment is higher than that of a lift cylinder connected to the lift arm and the main frame at both ends thereof (see a lift cylinder 950 in FIG. 8). As a result, the connecting position of the lift cylinder 50 to the main frame 2 (the position of the pin 36) is substantially at the same height as the connecting position of the front link 22 to the main frame 2 (the position of the pin 34). The connecting position of the lift cylinder 50 to the main frame 2 is also substantially at the same height as the connecting position of the rear link 21 to the main frame 2 (the position of the pin 31). Thus, the three pins 34, 31, 36 are positioned higher than the upper ends of the front and rear wheels 3, 4.

Therefore, the links 21, 22 and the lift cylinder 50 are not provided in the space directly rearward of the rear wheel 4 inside the support member 5. Even when other parts and members are equipped to the space, such parts and members do not interfere with the range of pivoting motion of the links 21, 22 and the lift cylinder 50. The other parts are efficiently provided without wasting the space, accordingly.

As shown in FIGS. 1 and 2, the counterweight 8 is provided in the above-described rear space (lower than the connecting positions of the links 21, 22 and the lift cylinder 50 with respect to the main frame 2, and directly rearward of the rear wheels 4 at the right and the left sides) in this embodiment. The counter weight 8 is specifically provided inside the support member 5 in this embodiment. The space rearward of the rear wheel 4 is appropriately spaced apart from the front axle 3A as the tipping fulcrum of the skid steer loader 1 for balancing the skid steer loader 1. By providing the counterweight 8 in this space, the stability in the fore-and-aft direction is highly improved.

In spite of the counterweight 8, the above-described rear space may be utilized as a space for, for example, a fuel tank for storing fuel for engine, an oil tank for storing hydraulic oil for the lift cylinder 50 and the like, and a battery. Thus, the freedom of the layout of parts is increased, thereby easily accomplishing a simplified and downsized structure of the skid steer loader 1. When heavy parts such as a fuel tank, an oil tank, and a battery and the like are provided in the rear space, these parts may serve as a counterweight.

[Operation]

Figure 5:
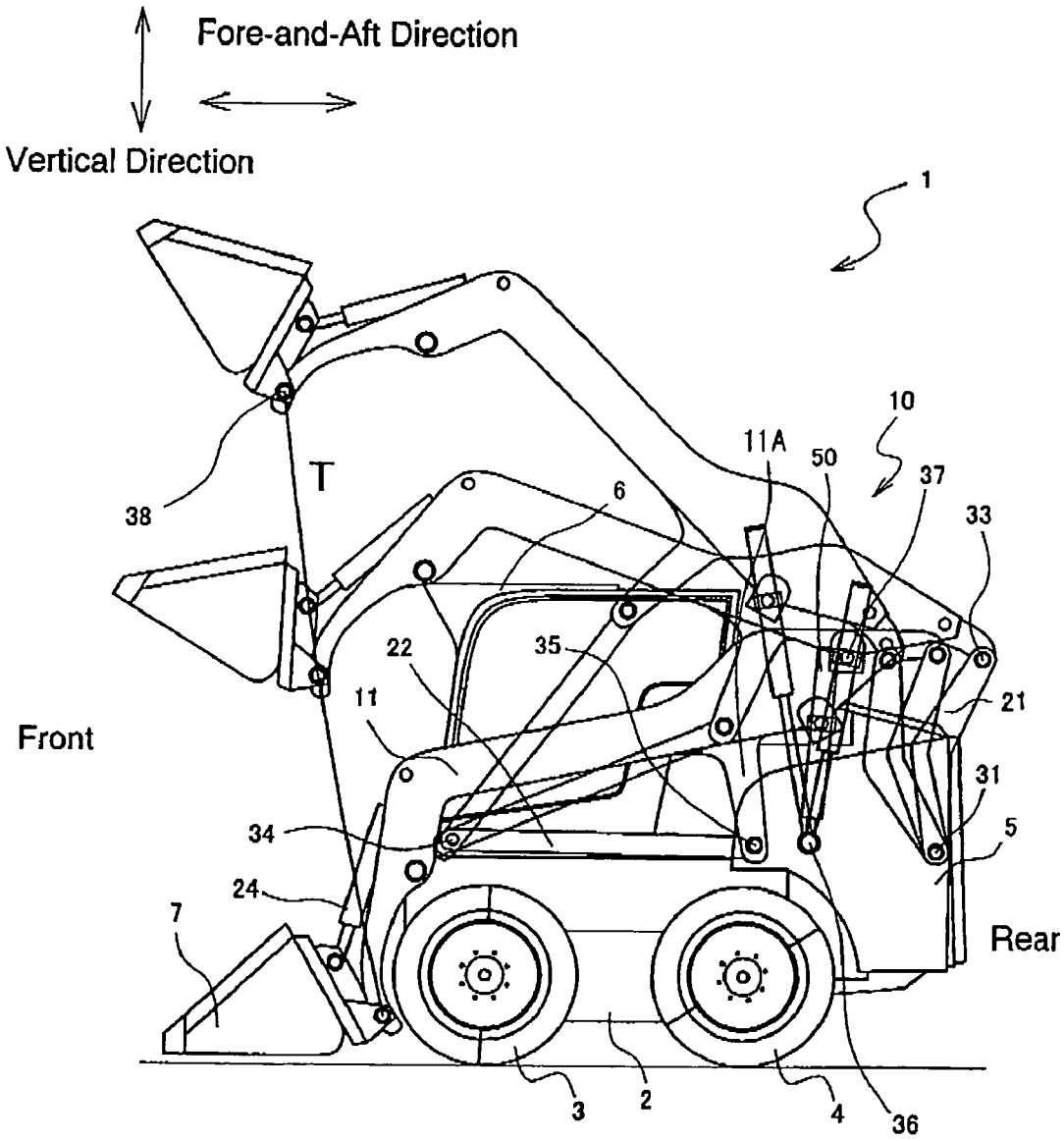
FIG. 5 is a side view of the skid steer loader of FIG. 1 illustrating an operation of a lift arm to be raised.
Figure 8:
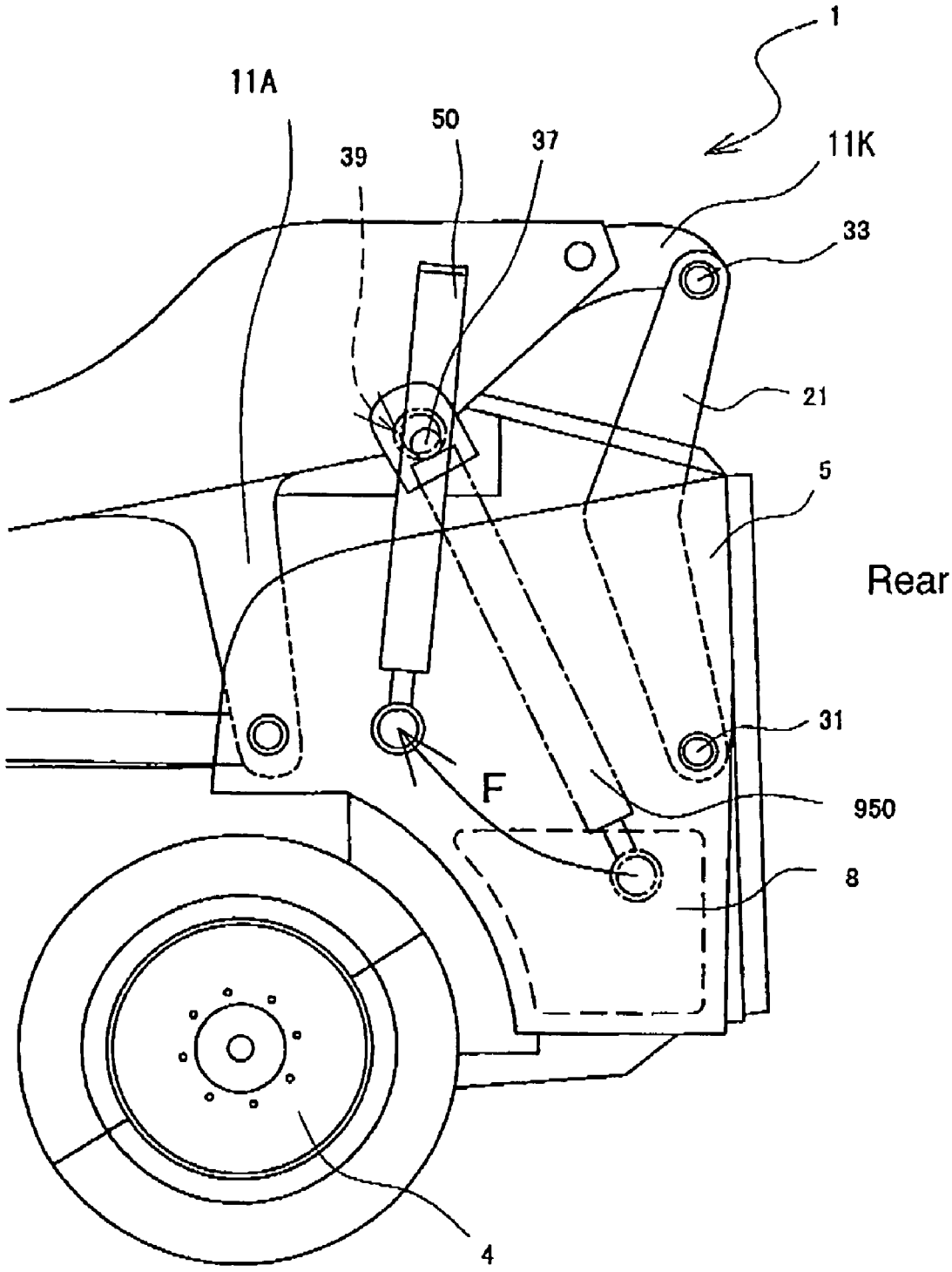
FIG. 8 is a rear side view explaining a position of a lift cylinder as a background art and a position of the lift cylinder according to the preferred embodiment of the present invention.

The following will describe the operation of the lift arm 11 during the elevation by the raising and lowering device 10. In FIGS. 5 and 8, the lift cylinder 50 is, for the sake of explanation, shown in such a manner that solid lines indicate not only visible parts but also parts hidden by other part. In FIGS. 1 and 2 where the lift arm 11 is lowered, the lift cylinder 50 is sufficiently retracted, and the front link 22 is directed rearward of the skid steer loader 1 substantially horizontally as viewed from the pin 34. The rear link 21 is extended upward in the vertical direction as viewed from the pin 31.

In this state, when the operator seated in the cabin 6 manipulates a load operating means (e.g. a lever or a pedal) which is not shown, oil under pressure is supplied to the lift cylinder 50. Thereby the lift cylinder 50 is extended and the lift arm 11 is raised in accordance with the pivot movement of the front link 22 toward the upright position (as shown in FIG. 6).

Figure 6:
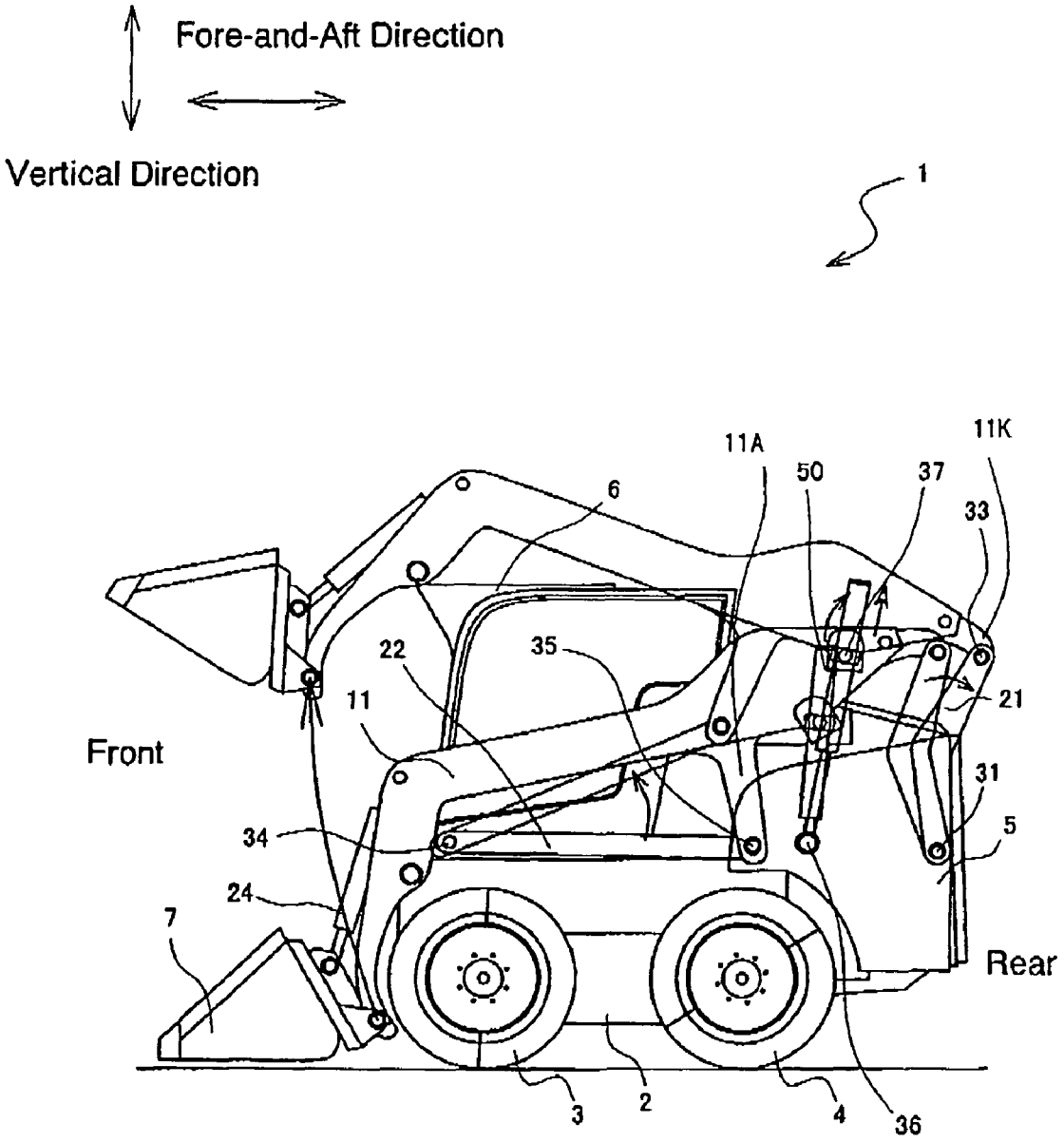
FIG. 6 is a side view of the lift arm of FIG. 5 illustrating a first half period of the operation of the lift arm to be raised.

During the initial period of raising the lift arm 11 (as shown in FIG. 6), the rear link 21 is pivoted so as to be tilted rearward in the clockwise direction around the pin 31 at the same time as the upward movement of the lift arm 11. Therefore, the lift arm 11 adjacent the proximal end 11K is moved rearward, and the bucket 7 at the front end of the lift arm 11 is raised while the bucket 7 is drawn rearward of the skid steer loader 1. Thus, in the first half of the operation for raising a load, the path of the front end of the lift arm 11 is substantially linear, though the path is slightly convex frontward.

Figure 7:
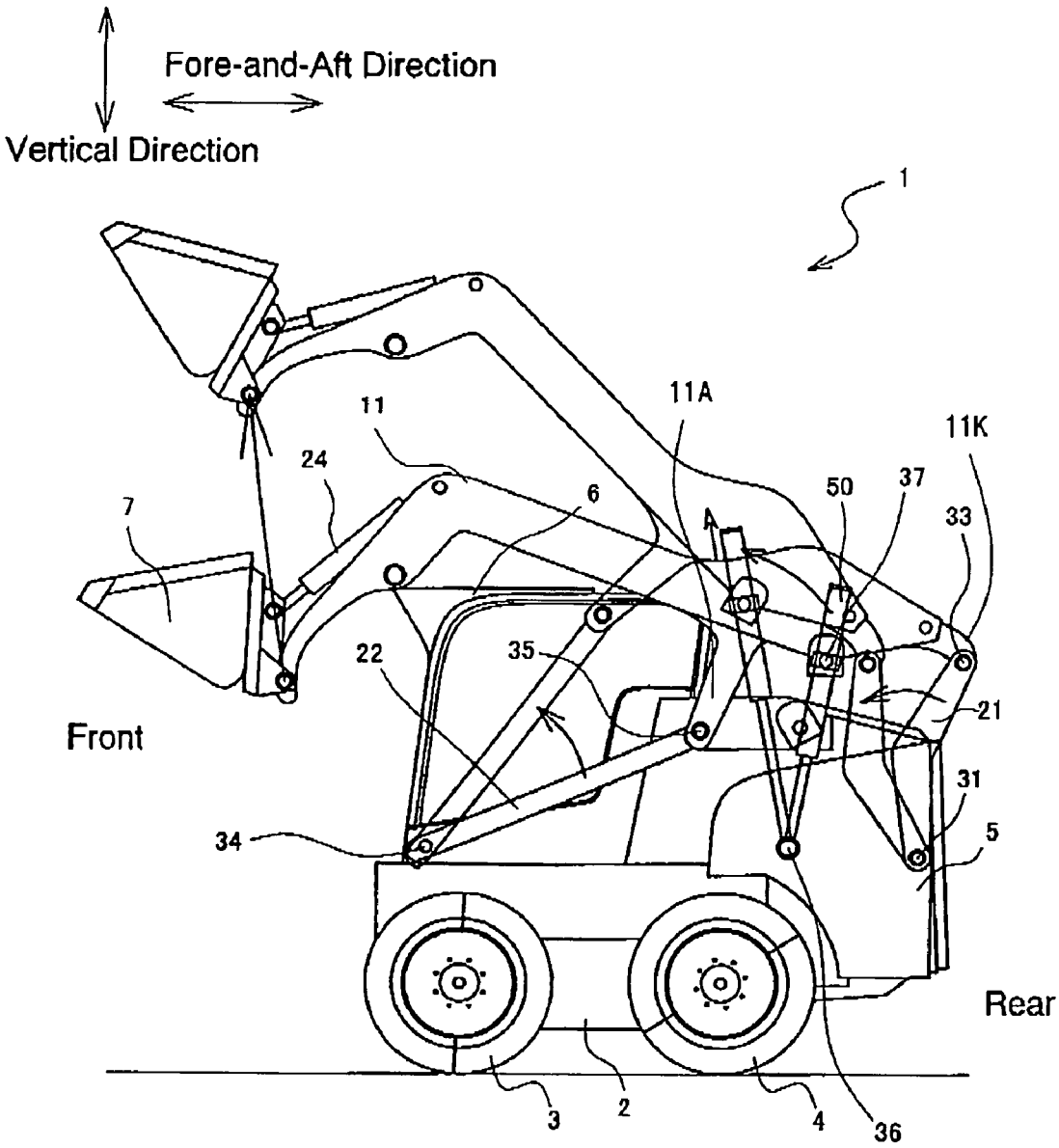
FIG. 7 is a side view of the lift arm of FIG. 5 illustrating a second half period of the lift arm to be raised.

When the lift cylinder 50 is further extended, the front end of the lift arm 11 reaches the intermediate height (the height of the pin 33) between the lowermost and the uppermost positions. Then, the rear link 21 is pivoted around the pin 31 and moved forward, or, toward the upright position as shown in FIG. 7. Thereby the lift arm 11 adjacent to the proximal end 11*k* is moved frontward, and the bucket 7 at the front end of the lift arm 11 is raised while being pushed frontward.

Thus, the lift arm 11 reaches the uppermost position, which is the upper one of the two lift arms 11 indicated in FIG. 7. The front end of the lift arm 11 is not drawn rearward at the uppermost position. Accordingly, a long frontward reach of the front end of the lift arm 11 is obtained.

As described above, in the initial period of raising the lift arm 11, the front end of the lift arm 11 is drawn rearward. In the latter period, the front end of the lift arm 11 is reversely pushed frontward. As a result, the path of the front end portion (pin 38) of the lift arm 11 where the bucket 7 is attached draws a gradual curve extending substantially along the vertical direction, as indicated by T in FIG. 5. The operation for lowering the lift arm 11 is reverse to the operation for raising the lift arm 11, and the explanation is omitted. Thus, the skid steer loader 1 is constructed such that the bucket 7 is raised and lowered in the vertical direction in accordance with the upward and downward movement of the lift arm 11 supported by the rear link 21. In the skid steer loader 1, the path of the bucket 7 draws the gradual curve substantially along the vertical direction. With such a construction, the skid steer loader 1 has a longer forward reach at the raised position of the lift arm 11 than a skid steer loader which draws simply an arc path during raising and lowering of a load. Therefore the skid steer loader 1 has high load workability.

[Effect]

As described above, the skid steer loader 1 of the preferred embodiment includes the main frame 2, the lift arm 11 with the bucket 7 attached to the front end thereof, and the lift cylinder 50. The lift cylinder 50 includes the piston 53, the bar-shaped piston rod 52 connected to the piston 53, and the cylinder tube 51. The cylinder tube 51 has the bottom portion 51A and the side wall portion 51B. The cylinder tube 51 of the lift cylinder 50 is connected to the lift arm 11. The piston rod 52 of the lift cylinder 50 is connected to the main frame 2. The connecting portion 39 of the cylinder tube 51 to the lift arm 11 is provided in the side wall portion 51B of the cylinder tube 51.

When a connecting portion of a lift cylinder with respect to a lift arm and a main frame is provided at ends of a cylinder tube and a piston rod, the connecting portion may be positioned rearward of the rear wheel (see the lift cylinder 950 in FIG. 8). In this case, a wide rear space rearward of the rear wheel is required for ensuring a space for pivoting movement of the lift cylinder. As a result, other parts are not provided at the rear space rearward of the rear wheel, thereby wasting the rear space. However, according to the preferred embodiment, the connecting position of the lift cylinder 50 to the main frame 2 is located at the upper part of the main frame 2 (as indicated by an arrow F in FIG. 8). The space for pivoting movement of the lift cylinder is shifted upward, and the space rearward of the rear wheel 4 accommodates other parts freely. Therefore, the skid steer loader according to the embodiment can utilize the rear space efficiently.

In the skid steer loader 1, the connecting portion 39 of the cylinder tube 51 to the lift arm 11 is positioned within the range of two-thirds of the entire length of the side wall portion 51B on the frame-side. Such a construction reduces the distance of the lift cylinder 50 between the connecting portion 39 to of the lift arm 11 and the connecting portion (by the pin 36) to the main frame 2 by at least one-third of the entire length of the side wall portion 51B. Therefore, the connecting portion of the lift cylinder 50 to the main frame 2 is shifted upward by at least one-third of the entire length of the side wall portion 51B. Thereby the rear space is utilized reliably and effectively without lowering the uppermost position of the bucket 7 when the lift cylinder 50 is extended maximum.

The connecting portion 39 is positioned within the range of two-thirds of the entire length of the side wall portion 51B adjacent to the frame-side. Further, the connecting portion 39 is positioned in the middle region C which corresponds the range of one-third of the entire length of the side wall portion 51B, excluding one-third of the entire length of the side wall portion 51B adjacent to the frame-side.

When the connecting portion 39 is positioned within the range of one-third adjacent the frame-side in the side wall portion 51B, the axis of the piston rod 52 may be easily displaced with respect to the axis of the cylinder tube 51. When the displacement is large, parts for preventing oil leakage may be deformed. In the above embodiment, the seal ring 53P at the periphery of the piston 53 serves for preventing oil leakage, and may be deformed. Such deformed parts may not function normally, and the oil may leak out from the inside of the cylinder tube 51. In this embodiment, the connecting portion 39 is provided in the vicinity of the middle of the cylinder tube 51. Thereby the oil leakage does not occur, and the rear space is utilized effectively and reliably.

The skid steer loader 1 has the pivotal rear link 21. One end of the rear link 21 is pivotally connected to the lift arm 11, and the other end of the rear link 21 is pivotally connected to the main frame 2. The bucket 7 is raised and lowered in the vertical direction in accordance with the upward and downward movement of the lift arm 11 supported by the rear link 21. With this construction, the path of the front end of the lift arm 11 is substantially set vertical, thereby ensuring the long reach of the bucket 7 when the bucket 7 is raised.

The bucket 7 is located in the front part of the skid steer loader 1. When the bucket 7 is at the lowermost position, the lift cylinder 50 is tilted rearward with respect to the vertical direction such that the bottom-side of the lift cylinder 50 is rearward of the frame-side of the lift cylinder 50. The lift arm 11 is required to be once moved rearward in the initial period of raising the lift arm 11, so as to raise the front end of the lift arm 11 in the vertical direction. With the construction where the lift cylinder 50 is tilted rearward, the lift arm 11 is easily moved rearward, and enables the effective elevation in the vertical direction.

The skid steer loader 1 includes the pair of the lift arms 11, and the pair of the lift cylinders 50. Each of the lift arms 11 is provided along the fore-and-aft direction of the main frame 2, respectively. The paired lift arms 11 are arranged so as to face to each other in the width direction that is perpendicular to the fore-and-aft direction and at the same time the horizontal direction. The lift cylinders 50 are provided on the inner side of the outermost surfaces 11S of the lift arms 11. When lift cylinders are arranged outside of lift arms, the size of the loader vehicle is increased by the width of the lift cylinder, unless decreasing the cabin space. With the construction of the preferred embodiment, the lift cylinder 50 does not increase of the size in the width direction, and is capable of decreasing the width of the skid steer loader without reducing the cabin space.

The paired lift cylinders 50 are arranged so as to overlap with the lift arms 11 in the width direction (so that each lift cylinders 50 is located within the width of the lift arm 11, in the top view). Thereby, the width of the skid steer loader 1 is reliably reduced without reducing the cabin space.

The connecting positions connecting the front link 22, the rear link 21, and the lift cylinder 50 with respect to the main frame 2 are located substantially at the same height. That is, the links 21, 22 and the lift cylinder 50 are connected to a region of the rigid main frame 2 at the same height, and thereby the lift arm 11 obtains a support structure with excellent mechanical strength. Thus, The skid steer loader 1 is applicable for heavy loading.

With the above arrangement of the connecting portion 39, each connecting positions of the links 21, 22 and the lift cylinder 50 to the main frame 2 are higher than the upper ends of the wheels 3, 4 of the skid steer loader 1. Therefore, the links 21, 22 and the lift cylinder 50 do not interfere with the front and rear wheels 3, 4 reliably. Further, the above structure contributes to the compactness of the skid steer loader 1. As described in the preferred embodiment, the links 21, 22 and the lift cylinder 50 are arranged so as to overlap with the front and rear wheels 3, 4 in the width direction. Thereby the front and the rear wheels 3, 4 and the lift arm 11 and the like are capable of being arranged in the width of the skid steer loader 1 reasonably. Thus, the above arrangement achieves a compact body in the width direction, which is appropriate for use in narrow passages. Additionally, a wide space is ensured in the cabin 6 interposed between the lift arms 11 and the like (specifically in the width direction).

In the preferred embodiment, the counterweight 8 is provided at the position lower than the connecting positions of the links 21, 22 and the lift cylinder 50 with respect to the main frame 2, and also rearward of the rear wheels 4. Therefore, the counterweight 8 is provided in a space which is wasted in the background art. Thereby the skid steer loader 1 accomplishes an effective layout and a compact vehicle body. The stability in the fore-and-aft direction is effectively improved so that the skid steer loader 1 does not tilt forward even when a heavy load is loaded by the bucket 7.

The connecting position of the front link 22 to the main frame 2 is located in the vicinity of the front part of the main frame 2. The length of the rear link 21 is not less than half of the front link 22. The connecting position of the rear link 21 to the main frame 2 is located rearward of the rear axle 4A of the skid steer loader 1. Therefore, by defining the substantially vertical path T as shown in FIG. 4, a long frontward reach is ensured at the raised position of the lift arm 11 and the workability is improved, while achieving the above described effects.

The preferred embodiment according to the present invention is only an example, and may be modified as follows.

In the preferred embodiment, the front link 22 and the rear link 21 are provided, however, the skid steer loader may be constructed such that the lift arm does not have a link and is directly connected to the main frame.

In the preferred embodiment, the counterweight 8 is provided inside of the support member 5. The counterweight 8 may be attached to the outside of the support member 5, or may be provided both inside and outside. A fuel tank or an oil tank may be provided in the similar way to the counterweight 8.

In the preferred embodiment, the lift arm 11, the links 21, 22, and the lift cylinder 50 and the like are arranged so as to overlap with the front and rear wheels 3, 4 in the width direction in the top view. The lift arm 11, the links 21, 22, the lift cylinder 50, and the like may not be arranged so as to overlap with the wheels 3, 4. However, at least a part of the lift arm 11, links 21, 22, the lift cylinder 50 and the like may be preferably arranged so as to overlap with the wheels 3, 4, considering downsizing for workability on narrow passages while ensuring a wide space in the cabin 6. It may be further preferable, when all of the lift arm 11, links 21, 22, the lift cylinder 50 and the like are arranged so as to overlap with the wheels 3, 4 (within the width of the wheels in the top view).

The application of the raising and lowering device 10 is not limited to the skid steer loader 1. The raising and lowering device 10 may be applied to any loader vehicle in which the front end of the lift arm defines a vertical path when the lift arm is raised or lowered.

In the preferred embodiment, the connecting portion 39 is provided in the middle region (the region C in FIG. 4) in side wall portion 51B. The connecting portion 39 may be provided in the range B or D in FIG. 4.

In the preferred embodiment, the lift cylinder 50 is tilted rearward with respect to the vertical direction such that the bottom-side is rearward of the frame-side, when the bucket 7 is at the lowermost position. The lift cylinder 50 may be provided upright, or tilted frontward when the bucket 7 is at the lowermost position.

In the preferred embodiment, each of the paired lift cylinders 50 is arranged so as to overlap with the lift arm 11 in the width direction (so that the lift cylinder 50 is located within the width of the lift arm 11 in the top view). The paired lift cylinders 50 may not be arranged so as to overlap with the lift arms 11 in the width direction, as long as the lift cylinders 50 are located on the inner side of the outermost surfaces 11S of the lift arms 11. Alternatively, the pair of the lift cylinders may be provided at the outside of the outermost surfaces of the lift arms in the width direction.

In the preferred embodiment, the lift arms, the lift cylinders and the like are provided at the both right and left sides in the paired manner. Each of the lift arms, the lift cylinders and the like may be provided one by one independently, or more than three of the lift arms, the lift cylinders and the like may be provided.

The present examples and embodiments are to be considered as illustrative and not restrictive, and the invention is not to be limited to the details given herein but may be modified within the scope of the appended claims.

What is claimed is:

1. A loader vehicle comprising:

a main frame;

a lift arm connected to the main frame, wherein a working implement is attached to the lift arm at the forward end thereof, wherein the lift arm is provided as a pair of lift arms, and the pair of lift arms is provided in the fore-and-aft direction along the main frame, wherein each of the pair of lift arms faces to each other in a width direction;

a front link pivotally connecting each lift arm to the main body, wherein the front link is provided as a pair of front links, one end of each front link is pivotally connected to a lift arm and the other end of that front link is pivotally connected to the main body;

a rear link pivotally connecting each lift arm to the main body, wherein the rear link is provided as a pair of rear links, one end of each rear link is pivotally connected to the rear end of a lift arm and the other end of that rear link is pivotally connected to the main body; and a lift cylinder pivotally connected to the lift arm and the main frame, the lift cylinder including:

a piston, a piston rod fixed to the piston and pivotally connected to the main frame, and a cylinder tube having a bottom portion and a side wall portion, wherein the cylinder tube is pivotally connected to the lift arm at a position forward of the rear link by a connecting portion, wherein the connecting portion is provided at the side wall portion of the cylinder tube, wherein the lift cylinder is provided as a pair of lift cylinders, and the pair of lift cylinders is provided on the inner side of outermost surfaces of the lift arms, wherein each lift cylinder is arranged so as to overlap with its lift arm, respectively, wherein each lift arm has a hollow center, and a part of each lift cylinder is inserted in its lift arm, wherein a part of each cylinder tube is interposed between the side plate portions of its lift arm;

and wherein each front link, piston rod and rear link is pivotally connected to the main frame at connecting positions that are substantially the same height along the main frame and disposed in this order.

2. The loader vehicle according to claim 1, wherein the side wall portion of each lift cylinder has a frame-side and a bottom-side, wherein the connecting portion is positioned at the side wall portion within a range of two-thirds of the entire length of the side wall portion adjacent to the frame-side.

3. The loader vehicle according to claim 2, wherein the connecting portion of each lift cylinder is provided at a middle region which corresponds a range of one-third of the entire length of the side wall portion, excluding a range of one-third of the entire length of the side wall portion adjacent to the frame-side.

4. The loader vehicle according to claim 1, wherein the working implement is raised and lowered in the vertical direction in accordance with the upward and downward movement of the lift arm.

5. The loader vehicle according to claim 4, wherein each lift cylinder has a frame-side and a bottom-side, wherein the working implement is located at the front part of the loader vehicle, wherein each lift cylinder is tilted rearward with respect to the vertical direction so that the bottom-side of each lift cylinder is located rearward of the frame-side of that lift cylinder when the working implement is at the lowermost position and is tilted forward with respect to the vertical direction so that the bottom-side of each lift cylinder is located forward of the frame-side of that lift cylinder when the working implement is at the highestmost position.

6. The loader vehicle according to claim 1, wherein the loader vehicle further includes front and rear wheels, wherein the connecting positions of the lift cylinders, the front links, the rear links with respect to the main frame are located higher than the upper ends of the wheels.

7. The loader vehicle according to claim 6, wherein the main frame includes a support member, and a counterweight is provided in the support member at a position lower than the connecting positions of the lift cylinders, the front links, and the rear links with respect to the main frame, wherein the counterweight is located rearward of the rear wheel.

8. The loader vehicle according to claim 3, wherein the piston has a seal ring for preventing oil leakage at the periphery thereof.

* * * * *